United States Patent [19]

Bernstein

[11] 4,033,432

[45] July 5, 1977

[54] CRANKCASE OIL DRAINAGE AND CONTAINMENT APPARATUS

[76] Inventor: Bertram J. Bernstein, 3144 Briand Ave., San Diego, Calif. 92122

[22] Filed: Aug. 29, 1975

[21] Appl. No.: 609,110

[52] U.S. Cl. ..... 184/1.5; 222/530; 222/538

[51] Int. Cl.[2] ..... F01M 11/04

[58] Field of Search ..... 184/1.5; 222/530, 538

[56] References Cited

UNITED STATES PATENTS

| | | | |
|---|---|---|---|
| 1,613,739 | 1/1927 | Besonett | 184/1.5 |
| 1,816,004 | 7/1931 | Collier | 184/1.5 |
| 2,006,194 | 6/1935 | Bertschinger | 222/530 |
| 3,103,947 | 9/1963 | Mueller | 84/1.5 |
| 3,160,333 | 12/1964 | Budrow | 222/538 |
| 3,650,352 | 3/1972 | Schwary | 184/1.5 |
| 3,727,638 | 4/1973 | Zaremba | 184/1.5 |
| 3,867,999 | 2/1975 | Cox | 184/1.5 |
| 3,871,483 | 3/1975 | Espinosa | 184/1.5 |
| 3,874,478 | 4/1975 | Mantell, Jr. | 84/1.5 |

*Primary Examiner*—Samuel W. Engle
*Assistant Examiner*—Thomas H. Webb
*Attorney, Agent, or Firm*—Frank D. Gilliam

[57] ABSTRACT

Apparatus for draining and containing the used oil supply from a vehicle crankcase is provided including a pass-through nipple and a connecting flexible hose, control of the drainage being effected by the simple act of lowering and raising of the free end of the hose from a convenient and accessible position within the open hood of the vehicle without requiring a complex valve or the need for the user to crawl under the vehicle.

3 Claims, 4 Drawing Figures

CRANKCASE OIL DRAINAGE AND CONTAINMENT APPARATUS

BACKGROUND OF THE INVENTION

The invention relates to apparatus for assisting in the drainage of contaminated oil from a vehicle's crankcase, and more particularly to such apparatus that will enable the operation to be conducted conveniently and in an expeditious manner without the need for the user to crawl beneath the vehicle to initiate and/or terminate the drainage operation.

Apparatus of this type has been advanced previously to simplify complex drainage valve systems, typical examples being U.S. Pat. Nos. 3,727,638, 3,874,478, and 3,806,085. In each of these patented constructions, the simple conventional crankcase drainage plug is discarded and replaced by a relatively complex valve that controls the flow of contaminated oil drained from the crankcase, by opening and closing adjacent the crankcase drain constructions utilizing a hose required them to be connected and removed after each drainage operation.

SUMMARY OF THE INVENTION

Apparatus is provided for expeditiously and conveniently controlling the drainage of the contaminated oil from a vehicle crankcase at a position from within the top of the engine compartment, eliminating the need for the user of crawling beneath the vehicle to start and terminate the operation.

The drainage apparatus includes a flow-through threaded nipple having an exit opening that permanently replaces the plug that is normally provided in each crankcase. One end of a several foot flexible hose is permanently secured to the exit opening of the nipple. The other end of the hose, being a free end, is releasibly secured within the top of the engine compartment, such as on the engine side of the fender well where it will be convenient to the user with the hood open. The hose is approximately 3 to 3½ feet in lenght, depending on the size of the vehicle, so that it will extend from the secured nipple up through the engine compartment to its releasibly secured position. From this position, the free end of the hose can be released and dropped to the ground to commence the drainage operation. Before dropping the free end, a disposable bag is attached thereto to avoid any spillage.

A retrieval line is connected at one end to the free hose end, and at the other end is secured to within the engine compartment to enable the free hose end to be retrieved and again secured to the stowed position, that is, after the filled bag of contaminated oil is removed and discarded. When in the upper, stowed position the free hose end may be closed by a cork to prevent and leakage of oil, and to prevent dust or water from entering the crankcase.

OBJECTS OF THE INVENTION

An important object of this invention is to provide apparatus for draining the used vehicle crankcase oil without the need for crawling beneath the vehicle to start and/or terminate the drainage operation.

Another important object of this invention is to provide such apparatus wherein the control of the drainage is in the act oflowering and raising of the free hose end with respect to the level of the oil in the crankcase.

Still a further object is to provide such apparatus which is simple and inexpensive in cost, and which can be operated without soiling the hands or clothes of the user.

DRAWINGS

DESCRIPTION

Figure 1:
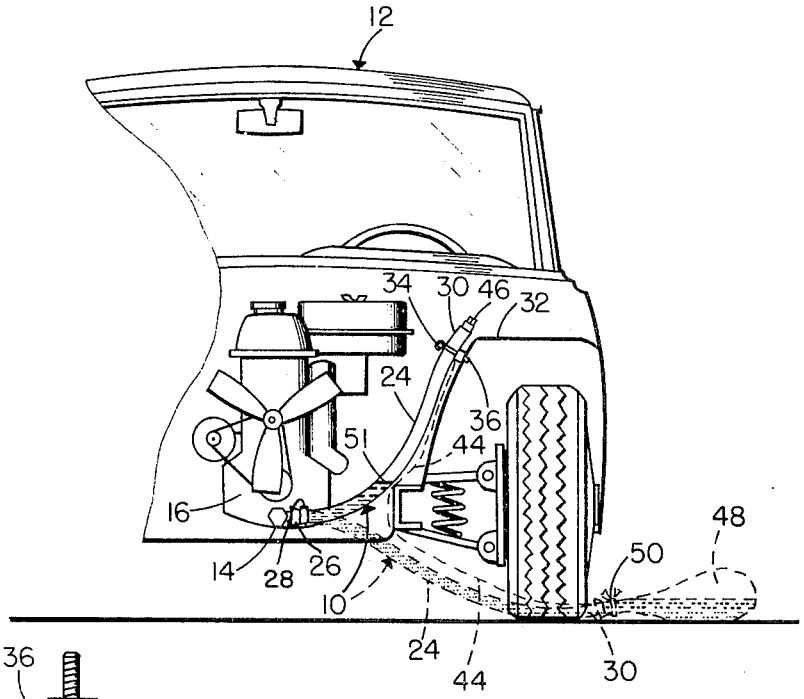
FIG. 1 is a front elevation view of one side of the front of a auto with the radiator removed and the hood opened showing the novel crankcase oil drainage apparatus in a normally stowed position in solid lines, and in a draining position in broken lines.

Referring to the drawings there is shown in FIG. 1 a general arrangement of my novel oil drainage apparatus 10 shown attached to the vehicle crankcase at one side of the engine, preferably the side where the oil filler opening is located, with the apparatus shown both in a normally stowed position in solid lines, and in a draining position shown in broken lines.

Figure 2:
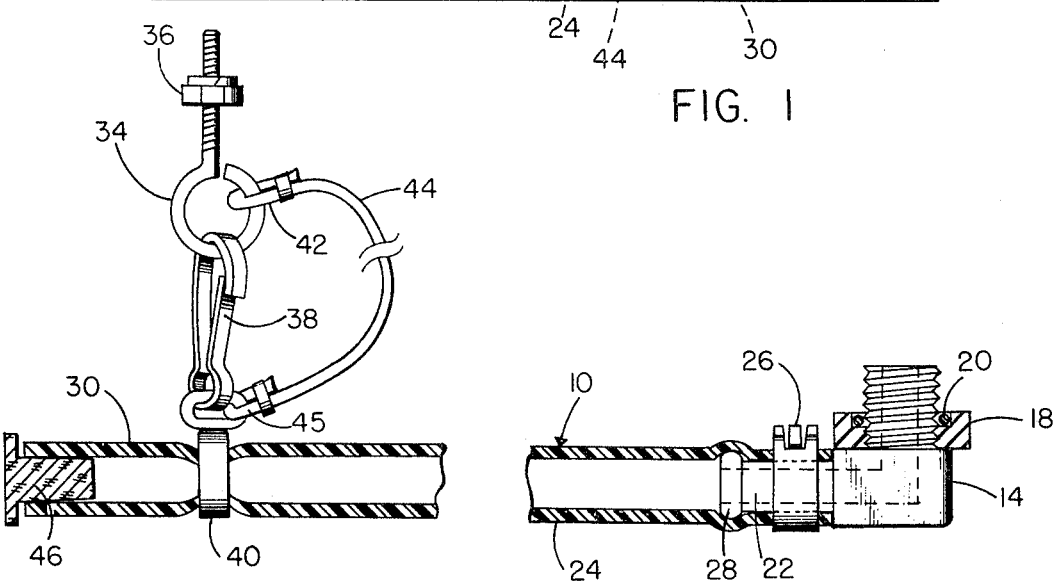
FIG. 2 is an enlarged elevation view of the drainage apparatus removed from the vehicle.
Figure 3:
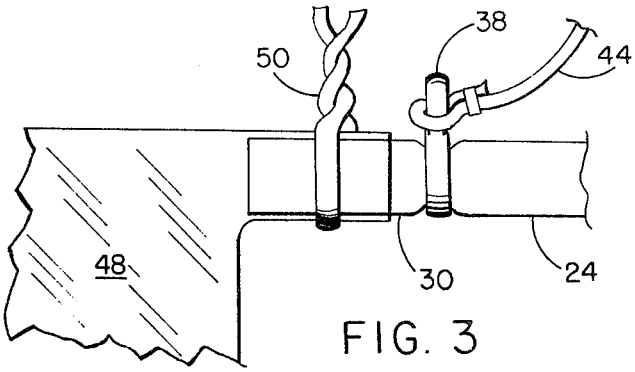
FIG. 3 is a partial elevation of the freehose end attached to a disposable plastic bag.
Figure 4:
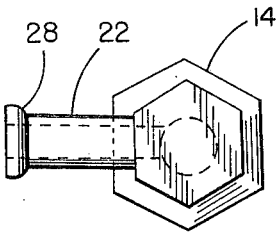
FIG. 4 is a plan view of the drainage nipple.

As better shown in FIG. 2, drainage apparatus 10 comprises a flow-through nipple 14 that when attached to the crankcase 16 permanently replaces the conventional crankcase plug (not shown) which normally blocks the crankcase drainage opening. Threadedly mounted on one end of nipple 14 is a jam nut 18 around which is seated an o-ring 20. At the other end of nipple 14 is integrally formed a spout 22, to which is fixedly secured by means of clamp 26 or the like, one end of a flexible hose or tubing 24. Spout 22 is formed with an annular lip 28 to ensure that the hose end clamp 26 will not inadvertently slip off once the apparatus is a attached in position to the crankcase. For all practical purposes, it is preferred that securing means 26 permanently attaches the hose end to spout 22 to discourage accidental or intentional removal, to prevent the loss of crankcase oil that can cause serious damage to the vehicle engine.

Tubing 24 is approximately 3.5 feet in lenght for the average auto to enable its free end 30 to be elevated through the engine compartment and secured at a suitable location therein, such as the engine side of fender well 32, as shown in the solid line position in FIG. 1. As shown in FIG. 2, the securing means for free tube end 30 can be a simple eyebolt 34 having a threaded end and nut 36 for mounting through the fender well. Free tube end 30 is secured in the stored position by a clip 38 releasibly connected to both eyebolt 34 and a hose tie 40.

Control over the stored and draining positions of the apparatus is achieved by a retrieval line 44 having one end 42 fixedly connected to eyebolt 34 and the other end 46 connected to hose tie 40. Line 44 is of a length to enable hose end 30 and line end 45, when disconnected from eyebolt 34 by clip 38, to be lowered thereby down through the engine compartment to lie on the ground (broken line position in FIG 1).

However, before hose end 30 is released to commence the drainage operation, it is advisible first to remove cork 46 and attach thereto a disposable plastic bag 48 by means of wire wrap 50. This is so because the crankcase starts to drain as soon as free hose end 30 drops below crankcase oil level 51 (see FIG. 1). Therefore, waiting to install disposable bag 48 after hose end 30 reaches the ground can be messy. After all, one of the principle advantages of this invention is to avoid such oil spillages that in the past has always been involved in the oil drainage operations. Thus, it is apparent that the lowering and raising of hose end 30 acts as a simple valve means for controlling the oil drainage operation without the need for any type of mechanical valve or tool. Upon completion of the draining operation, the oil filled bag 48, being readily accessible from the side of the vehicle, is easily removed from hose end 30 without the necessity of the user of crawling beneath the car. Cork 46 is reinserted in hose end 30, and the oil filled bag 48 is discarded. To restore hose end 30 to the upper secured position, the user need only haul up on retrieval line, and by means of clip 38 resecure it to eyebolt 34. It should be noted that cork 46 merely serves to close the end of the hose when not in a draining position, and does not function to block or seal any oil pressure in line 24 since none ever exits in the crankcase.

Thus it can be seen that the present invention eliminates the need for the relatively complicated oil valves suggested by the prior art, which apart from the cost, required the user to crawl beneath the vehicle to actuate the valve to initiate and terminate the draining operation. In place of the prior art valve, applicant employs a simple nipple and relies on the level of the attached extendable hose to act as the valve means. Accordingly, the drainage of the crankcase can be accomplished quickly and easily without the need for the user to don workclothes in order to twice crawl beneath the car; without the need to use a tool to loosen the crankcase plug or to manipulate a valve; and without the likelihood of creating a mess from the splashing of the drainage oil.

I claim:

1. Method for draining an automotive crankcase utilizing a flow through nipple for threaded attachment to the outlet of said crankcase, said nipple having an outlet enabling an unrestricted flow of oil therethrough, a long flexible drainage hose, said drainage hose connected to said nipple at one end and a free end of sufficient length so as to be able to project upwardly through the engine compartment to a stored elevated position where it is conveniently accessible to the user when the hood of the vehicle is open, attachment means for releasably securing said free end of said hose being within said engine compartment above the oil level in said crankcase and a retrieval line connected to said free end of said hose, the length of which is at least substantially the height between the securing means and ground level, said method comprising the steps of:

releasing said free end of said hose from said attachment means;

attaching a container in a sealed relationship with said free end of said hose prior to lowering to a drain position;

lowering said free end of said hose to a position below said crankcase;

allowing all of said oil to drain from said crankcase;

removing said container when all of said oil is drained from said crankcase; and returning said free end of said hose to said stored position.

2. The method as defined in claim 1, with the additional step of:

securing said free end of said hose to said attachment means.

3. The method as defined in claim 1, including steps of:

installing a cover over the free end of said hose when in a stored position; and removing said cover while draining said oil.

* * * * *